United States Patent [19]

Clark

[11] Patent Number: 5,052,962

[45] Date of Patent: Oct. 1, 1991

[54] NAVAL ELECTROCHEMICAL CORROSION REDUCER

[75] Inventor: Howard L. Clark, Ballston Lake, N.Y.

[73] Assignee: The United States of America as represented by the Secretary of the Navy, Washington, D.C.

[21] Appl. No.: 527,965

[22] Filed: May 21, 1990

[51] Int. Cl.[5] ..... B63H 23/34

[52] U.S. Cl. ..... 440/83; 440/113; 204/147

[58] Field of Search ..... 440/49, 73, 76, 79, 440/83, 111, 112, 113; 204/147, 148, 197, 196, 286, 153.15; 416/146 R, 247, 245 A, 247 A; 114/270

[56] References Cited

U.S. PATENT DOCUMENTS

| | | | |
|---|---|---|---|
| 3,033,775 | 5/1962 | Chevigny et al. | 204/147 |
| 3,108,940 | 10/1963 | Holdsworth | 204/147 X |
| 4,322,633 | 3/1982 | Staerzl | 204/147 X |
| 4,492,877 | 1/1985 | Staerzl | 204/147 X |
| 4,528,460 | 7/1985 | Staerzl | 204/196 X |
| 4,592,818 | 6/1986 | Cavil et al. | 204/147 X |

*Primary Examiner*—Ed Swinehart

*Attorney, Agent, or Firm*—James V. Tura; James B. Bechtel; Susan E. Verona

[57] ABSTRACT

A corrosion reducer for use with ships having a hull, a propeller mounted on a propeller shaft and extending through the hull, bearings supporting the shaft, at least one thrust bearing and one seal. The improvement includes a current collector and a current reduction assembly for reducing the voltage between the hull and shaft in order to reduce corrosion due to electrolytic action. The current reduction assembly includes an electrical contact, the current collector, and the hull. The current reduction assembly further includes a device for sensing and measuring the voltage between the hull and the shaft and a device for applying a reverse voltage between the hull and the shaft so that the resulting voltage differential is from 0 to 0.05 volts. The current reduction assembly further includes a differential amplifier having a voltage differential between the hull and the shaft. The current reduction assembly further includes an amplifier and a power output circuit receiving signals from the differential amplifier and being supplied by at least one current supply. The current selector includes a brush assembly in contact with a slip ring over the shaft so that its potential may be applied to the differential amplifier.

10 Claims, 2 Drawing Sheets

NAVAL ELECTROCHEMICAL CORROSION REDUCER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to marine corrosion protection systems, and more particularly to apparatus for protecting marine propulsion thrust bearings from damage due to galvanic effects in seawater.

Naval vessels which are constructed with bronze propellers and steel hulls or other dissimilar metals are subject to cathodic corrosion at the hulls due to an electro-chemical reaction with their sea environment. The seawater acts as an electrolyte with the two dissimilar metals generating a voltage between the cathodic propeller and anodic hull. To prevent the hull from corroding, zinc plates, galvanically more active in seawater than steel, are contiguously attached to the hull and act as sacrificial anodes which are consumed instead of the steel. That is, the zinc gives off electrons which then flow through the seawater, propeller and shaft seals, and bearings, to the hull, completing the electric circuit. The current through the seals and bearings, however, continues to produce cathodic corrosion at the seals and bearings. To prevent this, a grounding device has been used, such as a grounded copper braided strap riding on a slip ring on the shaft, which acts as a shunt for carrying the current from the shaft directly to the hull. It has been found that if the voltage differential between the shaft and the hull is maintained at less than 0.05 volts direct current (dc), there is no significant current, and deterioration of the seals and bearings is substantially obviated.

Operational problems, however, have continued both with grounding devices and with corrosion in the seals and bearings. Measurements carried out aboard marine vessels showed that shaft voltages in the order of 0.10 to 0.15 volts dc were not uncommon. This is because, in practice, the contact resistance between the shaft and the grounding device could not be reduced low enough to maintain the voltage below 0.05 volts dc. The shunt resistance of the various grounding devices is normally between 0.01 and 0.05 ohms, while a resistance of less than 0.001 ohms is needed.

There have been numerous attempts to stop the corrosion due to electrolytic action. In particular, U.S. Pat. No. 4,322,633 utilizes a relatively complex circuit with a marine transportation system to hold the parts at a selected potential by supplying electrical energy from a direct current source through a control circuit to a submergible anode. Because of its complexity, the protection system of the '633 patent is relatively expensive to produce and difficult to maintain. The disclosure of the '633 patent is incorporated herein by reference.

Further attempts to reduce the electrolytic corrosion of metal hulls of ships is illustrated in U.S. Pat. Nos. 3,022,234; 3.049,479; 3,169,504; and 3,385,254, all of which are incorporated herein by reference. All of the references cited herein utilize different outputs which are significantly different from those of the present invention, but show the extent of the problem and the complexity suggested by some of the solutions.

SUMMARY OF THE INVENTION

This invention relates to a corrosion reducer for use with a ship having a metal hull, a propeller mounted on a propeller shaft and extending to the hull, bearings supporting a shaft and at least one thrust bearing and one seal. The present invention in particular includes a current collector having electrical contact with the shaft, and a current reduction means which is in electrical contact with the current collector in the hull. The current reduction means further includes a means for sensing and measuring voltage between the hull and the shaft and means for applying reverse voltage between the hull and the shaft so that the resulting voltage differential between the hull and the shaft is from 0 to 0.05 volts and corrosion due to electrolytic action is thereby eliminated or substantially reduced. The current reduction means includes a differential amplifier having at its input the voltage differential between the hull and the shaft.

DESCRIPTION OF THE PREFERRED EMBODIMENT

Figure 1:
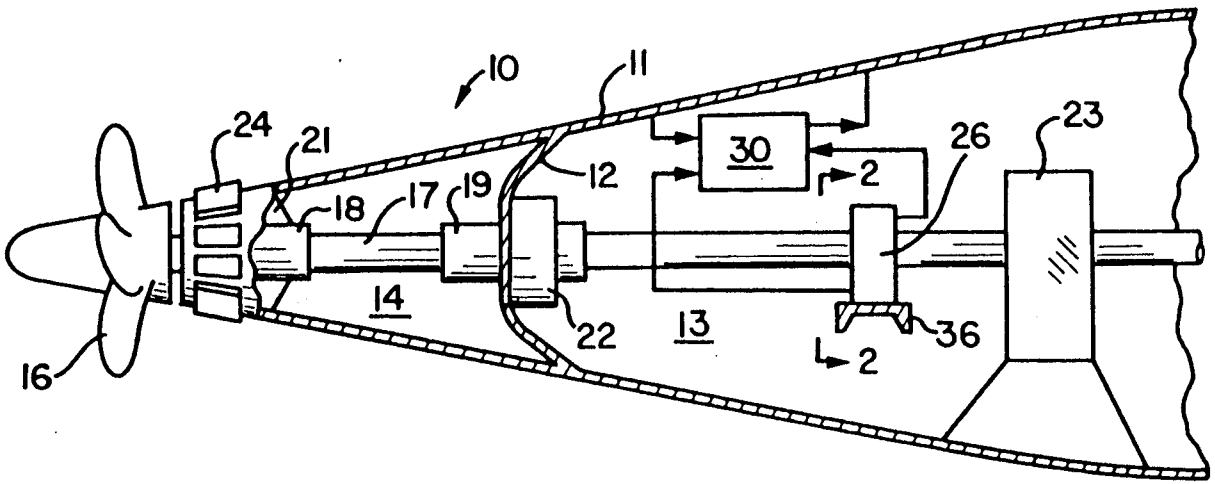
FIG. 1 is a cross-sectional elevation of the stern portion of a submarine propulsion system including a current collector and a current reduction means.

Referring now to the drawings wherein like characters designate like or corresponding parts throughout the several views, there is shown in FIG. 1 the stern portion 10 of a submarine propulsion system. A steel hull 11 with a transverse bulkhead 12 forms a watertight compartment 13 for housing machinery and crew and a stern tube 14 which may be internally exposed to the ambient sea. A bronze propeller 16 is connected for rotation with a propeller shaft 17 which extends forward through stern tube 14 and bulkhead 12 to a power plant (not shown) within compartment 13. Fore and aft stern tube bearings 18 and 19, fixed respectively to bulkhead 12 and hull struts 21, support shaft 17 in axial alignment in the submarine. A propeller shaft seal 22 on the inboard side of bulkhead 12 maintains pressure integrity between compartments 13 and 14, preventing ingress of seawater and egress of sealing fluid. A thrust bearing 23 interposed between seal 22 and the power plant provides a bearing surface for transferring the forward and reverse propulsion forces developed by propeller 17 when rotating.

To reduce corrosion of the steel hull 11 due to galvanic action with the bronze propeller 16 in seawater, zinc plates 24 are contiguously attached around hull 11 near propeller 16 and act as sacrificial anodes. Being galvanically more active in seawater than steel, the zinc plates 24 will be consumed instead. However, the presence of the two dissimilar metals and the seawater will nevertheless develop a voltage between the propeller 16 and hull 11. A dc current then flows from plates 24 through the seawater propeller 16, and shaft 17, and through four parallel paths in stern tube bearings 18 and 19, seal 22, and thrust bearing 23, to hull 16, resulting in significant electrochemical or electrolytic corrosion of the two latter components. To reduce the corrosive effect of the current through the seal 22 and thrust bearing 23, a current collector 26 is placed on shaft 17 in conjunction with a current reduction means 30.

Figure 3:
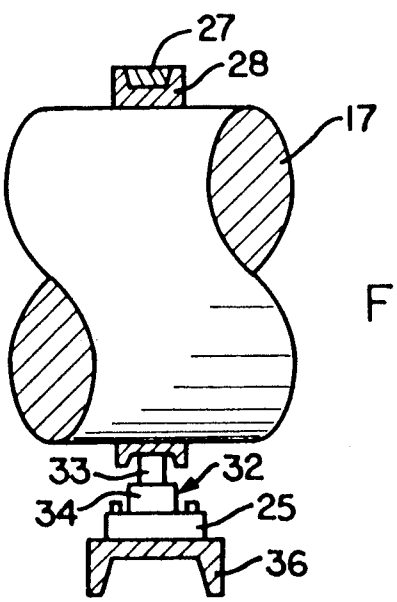
FIG. 3 is a cross-sectional view taken through section 3—3 of FIG. 2, and illustrates a section of the shaft and the mounting for the current collector.
Figure 2:
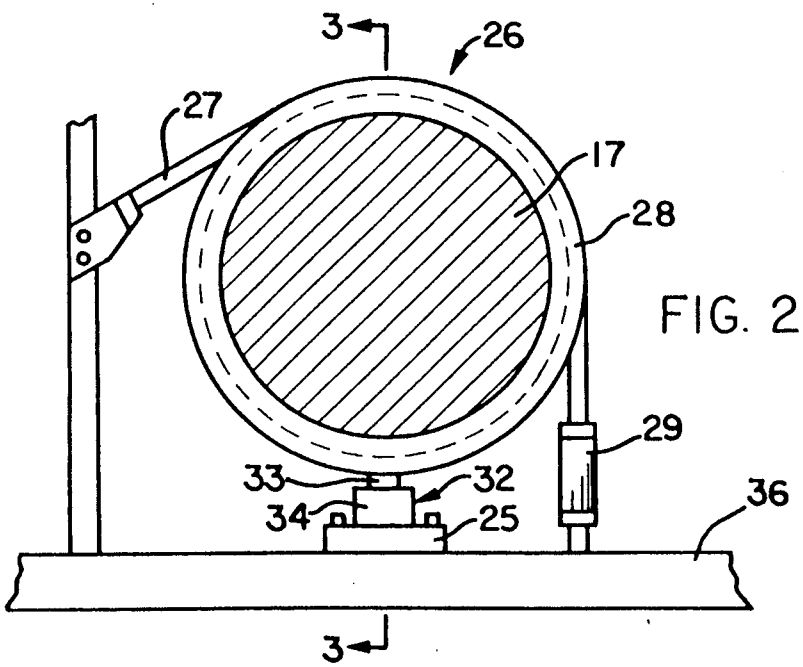
FIG. 2 is a cross-sectional view taken through section 2—2 of FIG. 1.

Referring to FIGS. 2 and 3, collector 26 includes a copper braid strap 27 stretched over a slip ring 28 on shaft 17 between an insulating block 25 and an insulating spring 29, each fixed to hull structure 36. Corrosion is usually insignificant below 0.05 volts dc. In practice, however, the contact resistance between shaft 17 and strap 27 cannot be maintained low enough to prevent corrosive damage.

Figure 4:
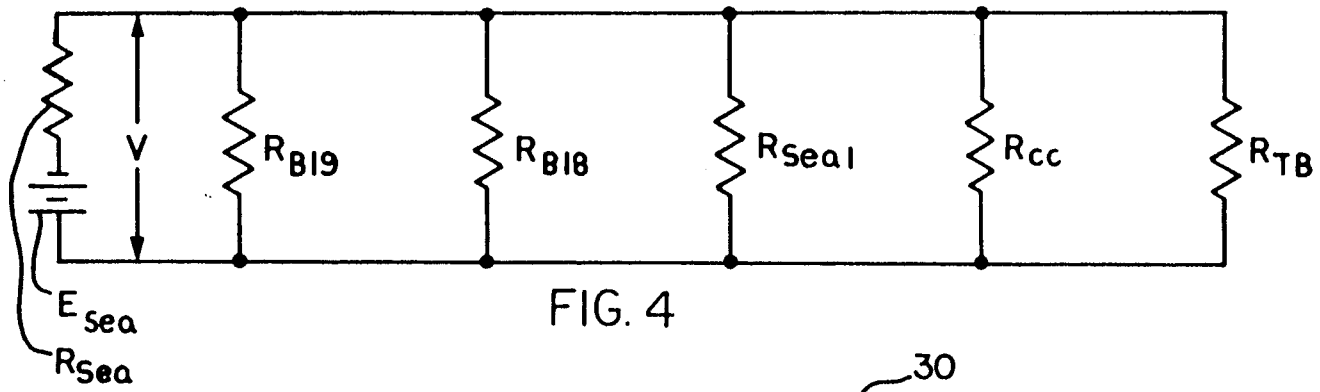
FIG. 4 is an equivalent electrical circuit of the voltages and resistances of the shaft.
Figure 6:
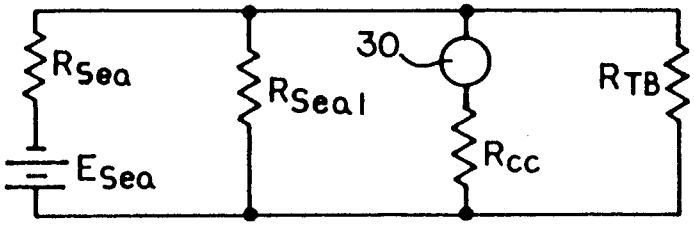
FIG. 6 is an equivalent circuit showing the current reduction means and the resistances of the thrust bearing, seal, and current collection means.

The current distribution through a propulsion system with a grounding device may be illustrated with reference to the equivalent electrical circuit of FIG. 4. The resistivity in the five parallel current paths between shaft 17 and hull 11 varies greatly from each other. Stern tube bearings 18 and 19 each have relatively high resistance $R_{18}$ and $R_{19}$, or low current, compared to the resistance of $R_{seal}$ of seal 22, $R_{tr}$ of thrust bearing 23 when rotating, and $R_{cc}$ of current collector 26. Consequently, most of the current passes through the latter three components, subjecting these to the most damage. The residual currents through stern tube bearings 18 and 19 have no significant corrosive effect. By way of example, the following are typical of the orders of magnitude of values in FIG. 4:

$R_{sea}=0.01\Omega$
$R_{B19}=1K\Omega$ to $1M\Omega$
$R_{B18}=1K\Omega$ to $0.5\Omega$
$R_{seal}=0.05\Omega$ to $0.5\Omega$
$R_{cc}=0.005\Omega$
$R_{tb}=0.05\Omega$ to $0.5\Omega$
$E_{sea}=1$ volt To minimize the corrosive effect of current through the seal 22 and bearing 23, a shaft voltage negator or current reduction means 30 regulates the voltage on propeller shaft 17 with respect to hull 11 to within 0.05 volts dc. This is accomplished by sensing differential voltage V between hull 11 and a brush assembly 32 electrically contacting shaft 17. Referring to FIGS. 2 and 3, assembly 32 includes silver graphite brushes 33 urged against slip ring 28 by a spring-loading holder 34 bolted on a horizontal channel 26 fixed to hull 11. Brushes 33 are electrically insulated from the support structure to minimize external electrical interference. The differential voltage of FIG. 4 is amplified for effectively producing a current substantially equal and opposite to the total current $I_T$ flowing through the seawater from the zinc plates 24 to propeller 16. FIG. 6 illustrates an equivalent electrical circuit, with the current reduction means 30 as applied according to the invention. The resistances of the stern tube bearings 18 and 19 have been disregarded in view of their high resistance and low current. The difference in potential $E_{sea}$ sets up a voltage differential across the four resistances $R_{sea}$, the resistance of the seawater, $R_{seal}$, the resistance of the seal 22, $R_{tb}$, the resistance of the thrust bearing, and $R_{cc}$, the resistance of the current collector. The current reduction means 30 acts in a manner to effectively reduce the voltage as set forth by the different voltages of the metals, and thus reduce the current to zero, or near zero, as a practical matter.

Figure 5:
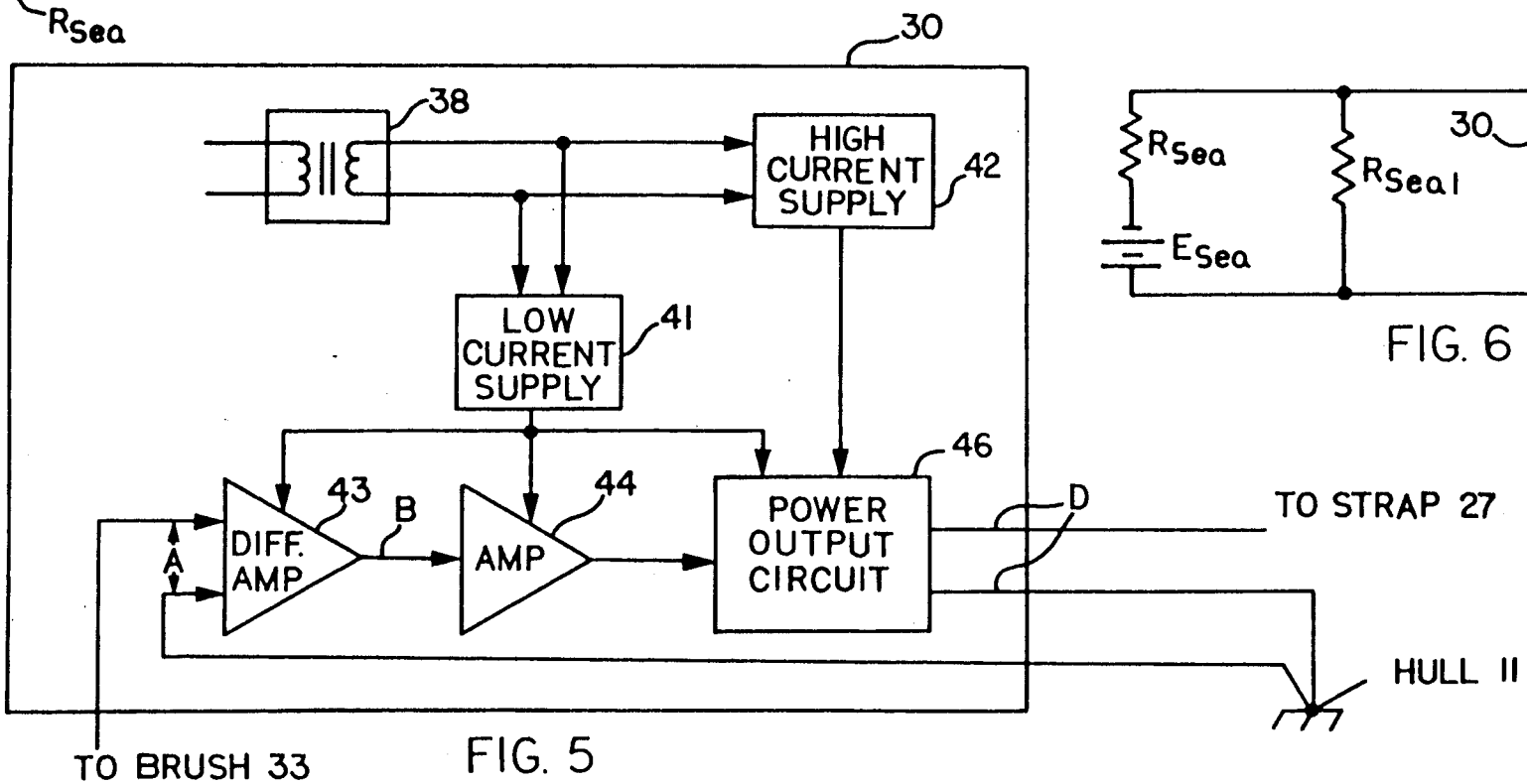
FIG. 5 is a block diagram of the current reduction means.

Referring now to FIG. 5, alternating current (ac) power is supplied to the current reduction means 30 which includes an isolation transformer 38 for guarding against any external electrical interference. The ac output of transformer 38 is fed to a low current power supply 41 which regulates the power necessary to operate the various electrical components within current reduction means 30. It also supplies a high current power supply 42 which provides power to current collector 26. The voltage difference signal A between brush 33 and hull 11 is sensed by a differential amplifier 43 whose output signal B is connected through an amplifier 44 to a power output circuit 46. The input impedance of amplifier 43 is preferably high so that the contact resistance of brush 33 can also be high without affecting operation. The gains of amplifiers 43 and 44, preferably 20X and 5X, respectively, provide a discernible input signal C to circuit 46 whose current output signal D is connected across collector 26 and hull 11. To maintain a shaft-to-hull voltage difference within a range of 0 to 0.05 volts dc, output circuit 46 typically requires an output capability of 0.25 to 5.00 volts dc at 100 amps.

Referring now to FIG. 5, alternating current (ac) power is supplied to current reduction means 30 through an isolation transformer 38 for guarding against any leakage or connection from the ship's power supply to the hull. The input to this transformer is normally the ship's 115-volt 60 Hz power, but could be as high as 440 volts if that were more convenient. The output of this transformer supplies the low current power supply 41 and the high current power supply 42, and is of a voltage which will normally provide a voltage of 100 volts at the output of the high current power supply. This is the preferred voltage for the semiconductors used in the power output circuit 46. Choice of other semiconductors might lead to the output of the high current supply being as low as 30 volts, or as high as 400 volts. The preferred low current supply output voltage is plus and minus 15 volts, but could be as low as 5 and as high as 30 volts, depending on the semiconductor types used in the amplifiers 43, 44 and the power output amplifier. The output power of the high current power supply will normally be up to 500 watts, and power consumed by the power output amplifier in providing the current output through the grounding device 26. The voltage difference between the brush assembly 32 and the hull 11 is sensed by differential amplifier 43, which amplifies this input by a preferred value of 20 times and is applied to a second amplifier 44 having a preferred gain of 5 times. This output is then applied to the input of power amplifier 46. These gain values may vary as long as the input to the differential amplifier of 0.05 volts will provide the maximum required output of 5 volts at 100 amperes from the power output circuit 46. While a linear amplifier could be used for the power output circuit 46, the preferred form is known as a pulse-width modulated chopper amplifier, which in this application has a much higher efficiency and leads to substantial economies in the size and weight of the high current power supply. In this arrangement, the voltage output from amplifier 44 applied to the input of power output circuit 46 modulates 20 kHz carrier in current pulses, the width of which are proportional to the input voltage. The current pulses pass through a transformer having a ferrite core producing output voltage on the secondary winding, a voltage which, when rectified and filtered in a manner familiar to anyone skilled in the art, produces a smooth output current of 100 amperes at a voltage up to 5 volts for an input to the differential amplifier 43 of 0.05 volts. This current is caused to flow from the current collector 26 through the output of the power amplifier circuit 46 to the hull 11. This current will cause the shaft 17 to decrease in potential, which reduces the input to the differential amplifier 43 toward zero. The balance point is reached where the output voltage of the power output amplifier 46 is just sufficient to maintain the shaft 17 voltage to very near zero with respect to the hull 11. Because the voltage is nearly zero, the current is nearly zero between the hull and the shaft. Electrochemical corrosion is thus also reduced to nearly zero.

In operation, differential amplifier 43 senses the voltage difference between brush assembly 32 and hull 11, causing power output circuit 46 to proportionately increase or decrease the voltage between current collector 26 and hull 11 so that the shaft-to-hull current is minimized.

Some of the many advantages and novel features of the present invention should now be apparent. For example, an apparatus is provided which will prevent or greatly reduce cathodic corrosion in the seals and bearings of marine propulsion systems by maintaining the voltage between the propeller shaft and the hull of the vessel at nearly zero. An active electronic system is provided in which the shaft-to-hull voltage difference is measured and a counteracting dc voltage is applied between the hull and a current collector on the shaft. Cathodic corrosion of the main shaft seal and the thrust bearing of a marine propulsion system is prevented, or greatly reduced, under all operating conditions by means of the current reduction means, which is simple to manufacture, install and operate on existing marine propulsion systems.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A corrosion reducer for use with a ship having a hull, a propeller mounted on a propeller shaft and extending through the hull, the hull and the shaft being of dissimilar metals, bearings supporting the shaft, at least one thrust bearing and one seal, the improvement comprising:

a current collector having an electrical contact with the shaft;

and a current reduction means which is in electrical contact with the current collector and the hull;

the current reduction means including a means for sensing and measuring a voltage between the hull and the shaft and means for applying a reverse voltage between the hull and the shaft so that the resulting voltage differential between the hull and the shaft is from 0 to 0.05 volts and corrosion due to electrolytic reaction is thereby eliminated or substantially reduced.

2. The corrosion reducer means of claim 1, wherein the current reduction means includes a differential amplifier having as its input the voltage differential between the hull and the shaft.

3. The corrosion reducer means of claim 2, wherein the current reduction means further includes an amplifier and power output circuit receiving signals from the differential amplifier and being supplied by at least one current supply.

4. The corrosion reducer means of claim 3, wherein the current collector includes a metal strap in electrical contact with the shaft and the current reduction means.

5. The corrosion reducer means of claim 4, wherein the current collector further includes a conductive slip ring mounted on the shaft so that it rotates with the shaft and is in contact with the metal strap which is fixed at each end.

6. The corrosion reducer means of claim 5, wherein the current collector further includes an electrical brush assembly in electrical contact with the slip ring and the differential amplifier in the current reduction means.

7. The corrosion reducer means of claim 2, wherein the propeller is bronze and zinc plates are attached to the hull, which is steel, so that if any electrolytic action takes place, the zinc plates will corrode and be sacrificed before the steel hull.

8. The corrosion reducer means of claim 2, wherein the current reduction means and current collector are operatively connected and placed in proximity to the thrust bearing and the seal to substantially reduce or eliminate their corrosion due to electrolytic action.

9. The corrosion reducer means of claim 4, wherein the current reduction means further includes an isolation transformer supplying a high current supply which in turn supplies a power output circuit, the isolation transformer further supplying a low current supply, which in turn supplies the differential amplifier, amplifier, and power output circuit.

10. The corrosion reducer means of claim 7, wherein the power output circuit is a pulse-width modulated chopper.

* * * * *